US007320452B2

(12) United States Patent
Chen

(10) Patent No.: US 7,320,452 B2
(45) Date of Patent: Jan. 22, 2008

(54) ADJUSTABLE RAIL-HANGING APPARATUS

(75) Inventor: Wen-Chun Chen, Tao Yuan (TW)

(73) Assignee: Hoolin Research Company Limited, Tao Yuan (TW)

( * ) Notice: Subject to any disclaimer, the term of this patent is extended or adjusted under 35 U.S.C. 154(b) by 163 days.

(21) Appl. No.: 11/082,691

(22) Filed: Mar. 18, 2005

(65) Prior Publication Data

US 2006/0208144 A1 Sep. 21, 2006

(51) Int. Cl.
*A47B 96/00* (2006.01)

(52) U.S. Cl. ..... 248/227.1; 248/301

(58) Field of Classification Search ..... 248/301, 248/307, 306, 225.21, 224.61, 224.51, 223.41, 248/303, 689, 690, 316.4, 316.1, 227.1, 231.41, 248/226.11; 211/162, 94.01, 87.01; 40/124.05, 40/661.03; 5/301, 304

See application file for complete search history.

(56) References Cited

U.S. PATENT DOCUMENTS 2,696,962 A * 12/1954 Goss ..... 248/477
2,940,718 A * 6/1960 Beal ..... 248/245
4,283,038 A * 8/1981 Kurtz ..... 248/478
4,340,199 A * 7/1982 Brock ..... 248/544
4,352,478 A * 10/1982 Loew ..... 248/222.11
4,450,655 A * 5/1984 Rosenthal et al. ..... 52/36.4
4,531,331 A * 7/1985 Itagaki ..... 52/38
4,591,058 A * 5/1986 Amstutz et al. ..... 211/94.01
4,678,151 A * 7/1987 Radek ..... 248/223.41
4,852,838 A * 8/1989 Field ..... 248/222.13
5,356,104 A * 10/1994 Rosenberg et al. .... 248/223.41
6,050,426 A * 4/2000 Leurdijk ..... 211/94.01
6,119,878 A * 9/2000 Zen ..... 211/94.01
6,811,043 B2 * 11/2004 Perkins et al. ..... 211/94.01
7,055,703 B2 * 6/2006 Perkins et al. ..... 211/94.01

* cited by examiner

*Primary Examiner*—A. Joseph Wujciak, III
(74) *Attorney, Agent, or Firm*—Troxell Law Office, PLLC

(57) ABSTRACT

An adjustable rail-hanging apparatus comprises a main body and a limit device, wherein a hooking part for hooking an aluminum extrusion hanging board is mounted on the upper end of the main body. First screw holes to be inserted by first locking devices are formed on both sides of the main body and guiding grooves are oppositely formed on both sides of the lower end of the main body respectively for movably holding the limit device. A hooking notch is formed on each holding part of the limit device. The adjustable limit device is movably shifted up and down by disposing second locking devices in the guiding grooves and holding the aluminum extrusion hanging board by the hooking notch and the hooking part on the upper end of the main body cooperatively. Consequently, the movable limit device is suitable for aluminum extrusion hanging board with various rail gauges.

3 Claims, 6 Drawing Sheets

ADJUSTABLE RAIL-HANGING APPARATUS

FIELD OF THE INVENTION

The present invention relates to an adjustable rail-hanging apparatus, and more particularly to the movably adjustable apparatus comprising a limit device to adapt to various aluminum extrusion hanging boards with various rail gauges and two kinds of locking devices to provide double fixing for the upper portion and the lower portion. Moreover, this apparatus further comprises several fitting holes with different-sized diameters to provide the easy usage for hanging bases with different purposes.

BACKGROUND OF THE INVENTION

The commonly seen aluminum metal provides with the distinguishing characteristics of lightened texture and large-scale plasticity. Accordingly, it is commonly seen that many commercial articles such as frames, window slideways, clothes hangers, and aluminum extrusion hanging boards are formed by aluminum extrusion. Referring to FIG. 6, the aluminum extrusion hanging board 10 at least comprises a lateral surface having recessed rails 101 to engage with a rail-hanging apparatus for holding articles.

The conventional rail-hanging apparatus shown in FIG. 6 comprises a main body 40 having a bended hooking part 41 to hook the aluminum extrusion hanging board 10. This rail-hanging apparatus is for a single purpose. Accordingly, fitting holes (not shown) reserved for a hanging base for this purpose are formed on the center of the main body 40.

Nevertheless, the above-mentioned rail-hanging apparatus is not further secured by locking devices so it is easy to wobble the hooking part 41 of the main body 40 on both sides of the aluminum extrusion hanging board 10. Besides, the right rail 101 on the aluminum extrusion hanging board 10 with proper rail gauge always cannot be found since the extent of the main body 40 is fixed. Accordingly, this conventional structure is short of convenience.

SUMMARY OF THE INVENTION

In view of the drawbacks of the prior art, the present invention discloses an adjustable rail-hanging apparatus to meet the requirement for industrial usage.

It is the main object of the present invention to provide an adjustable rail-hanging apparatus for adjusting extent according to the rail gauge of the aluminum extrusion hanging board such that it is suitable for the aluminum extrusion hanging board with various rail gauges.

It is another object of the present invention to provide the adjustable rail-hanging apparatus having at least two kinds of locking devices to enhance its stability after hooking and prevent the apparatus from being hit down after collision.

It is still another object of the present invention to form several fitting holes to engage with various hanging bases and bracing frames and meet the need to hang various articles.

DETAILED DESCRIPTION OF THE PREFERRED EMBODIMENT

Figure 1:
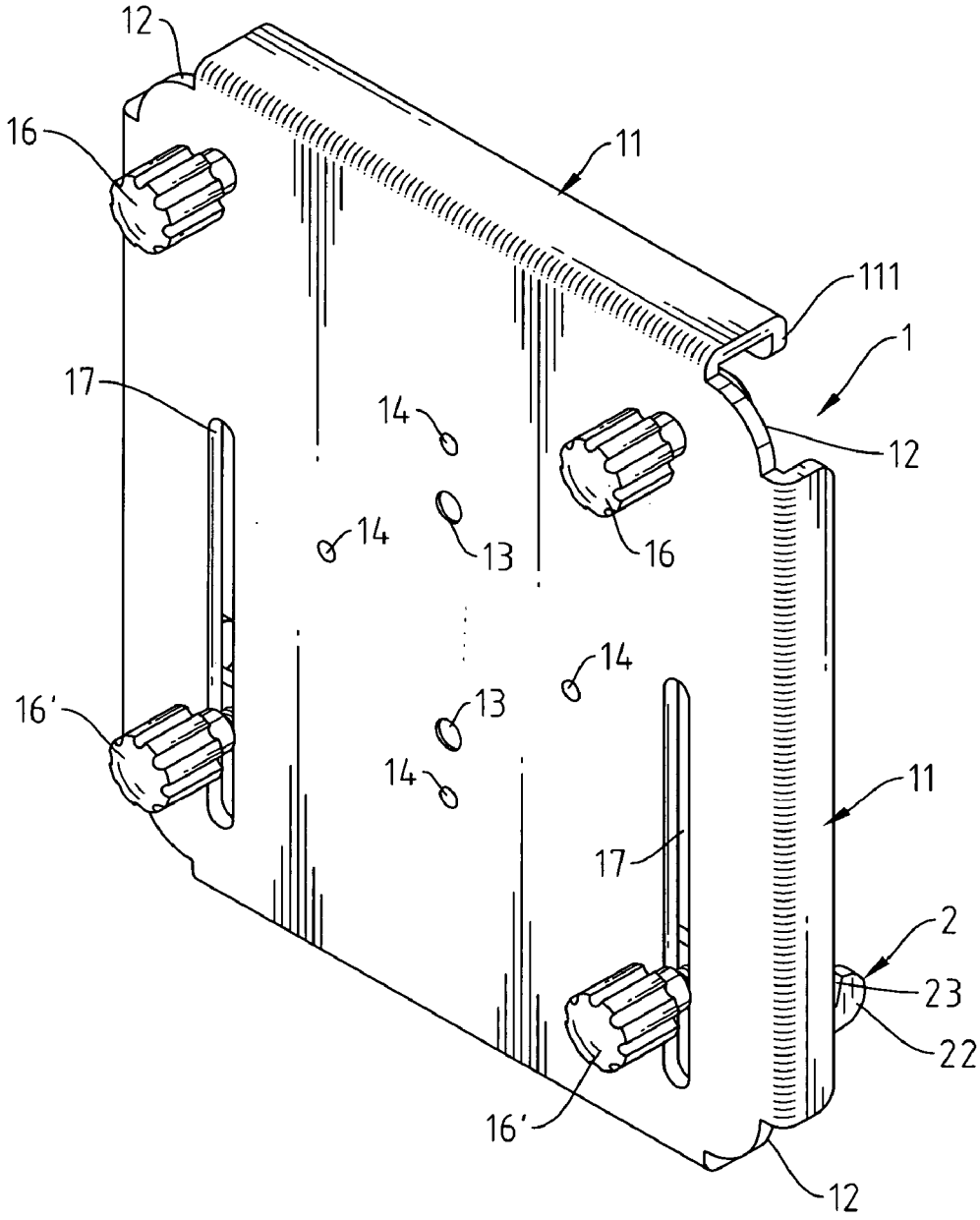
FIG. 1 is an elevational view showing the outward appearance of the adjustable rail-hanging apparatus of the present invention.
Figure 2:
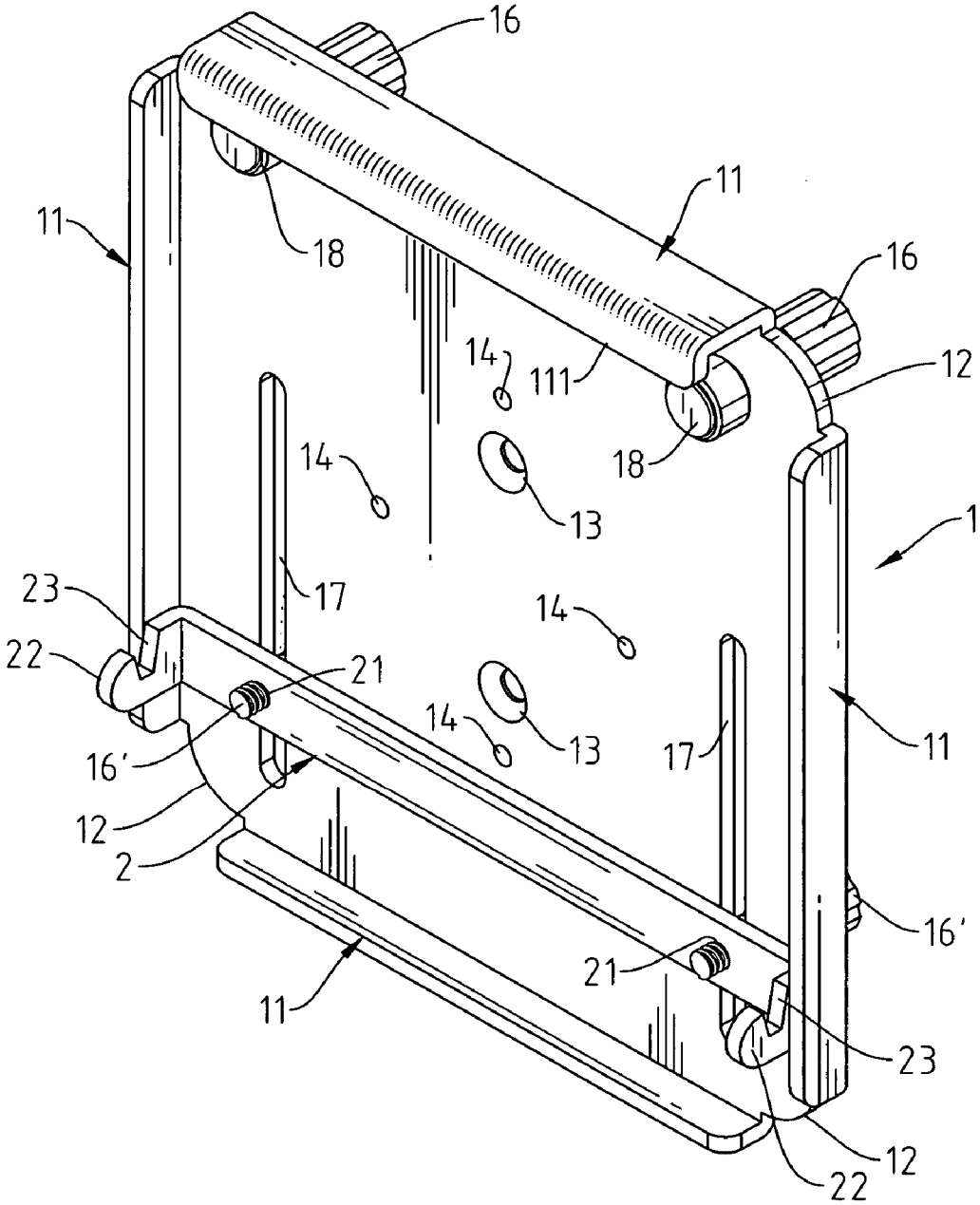
FIG. 2 is a back view showing the adjustable rail-hanging apparatus of the present invention.
Figure 3:
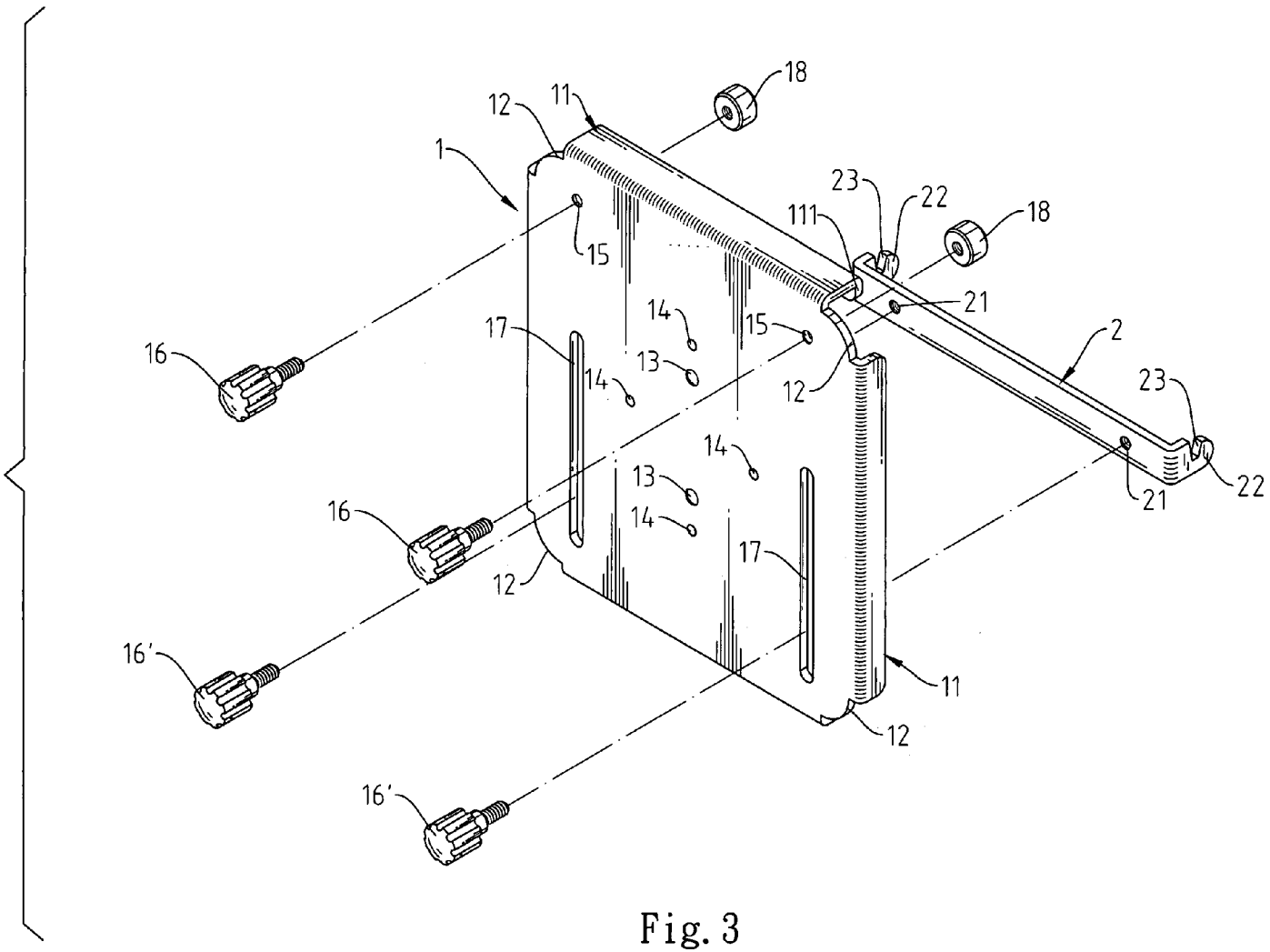
FIG. 3 is a decomposed elevational view showing the adjustable rail-hanging apparatus of the present invention.

The detailed structural feature and the preferred embodiment of the present invention will now be described in detail with reference to the accompanying drawings.

Referring to FIG. 1 through FIG. 4, an adjustable rail-hanging apparatus of the present invention comprises a rectangular main body 1 and a limit device 2. The main body 1 includes vertically bended lateral sides to form stoppers 11, wherein an arc-shaped gap 12 is formed between every two adjacent stoppers 11, and the stopper 11 on the upper end of the main body 1 further includes a hooking part 111 to hook an aluminum extrusion hanging board 10. Several fitting holes 13, 14 with different-sized diameters are formed on the center of the main body 1. Besides, screw holes 15 to be inserted by locking devices 16 are formed on both sides of the upper end of the main body 1 and two oppositely parallelized guiding grooves 17 are formed respectively on both sides of the main body 1 for movably holding the limit device 2, wherein these two guiding grooves 17 extend equally from the lower end of the main body 1 to the intermediate portion of the main body 1. The locking devices 16 may be used together with gaskets 18 to increase the contact area and the friction force, thereby fixing to the aluminum extrusion hanging board 10 more securely and preventing the damage caused by the direct contact between the locking devices 16 and the aluminum extrusion hanging board 10.

Figure 4:
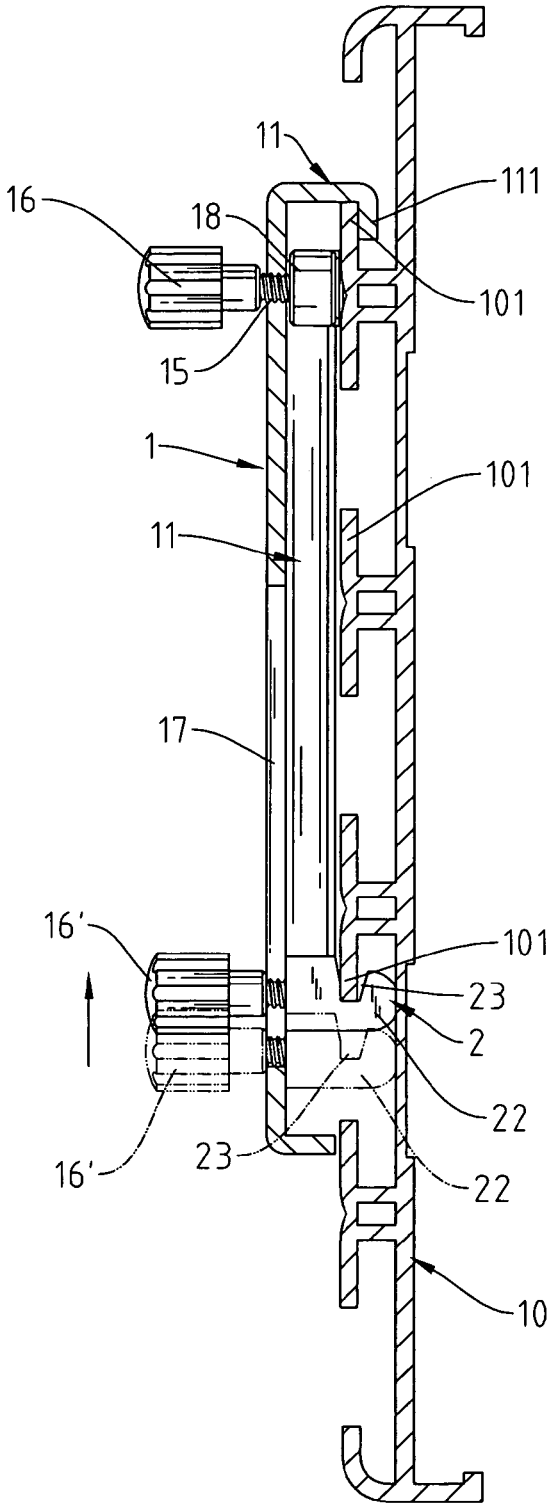
FIG. 4 is a schematic cross-section view showing the usage status of the present invention.

The limit device 2 includes screw holes 21 formed on both sides of its shaft surface respectively and cooperated with locking devices 16' for use. The both ends of the limit device 2 are bent to form holding parts 22, wherein each holding part 22 has a hooking notch 23 for holding a rail 101 of the aluminum extrusion hanging board 10. The limit device 2 is provided with movable connection principally by disposing the locking devices 16' in the guiding grooves 17 and through the screw holes 21 and securely engaging the limit device 2 with the backside of the main body 1. As shown in FIG. 4, the adjustable limit device 2 is movably shifted up and down by disposing the locking devices 16' in the guiding grooves 17 and utilizing the stopper 11 on the upper end of the main body 1 cooperatively. Consequently, the movable limit device 2 is suitable for the aluminum extrusion hanging board 10 with various rail gauges.

Figure 5:
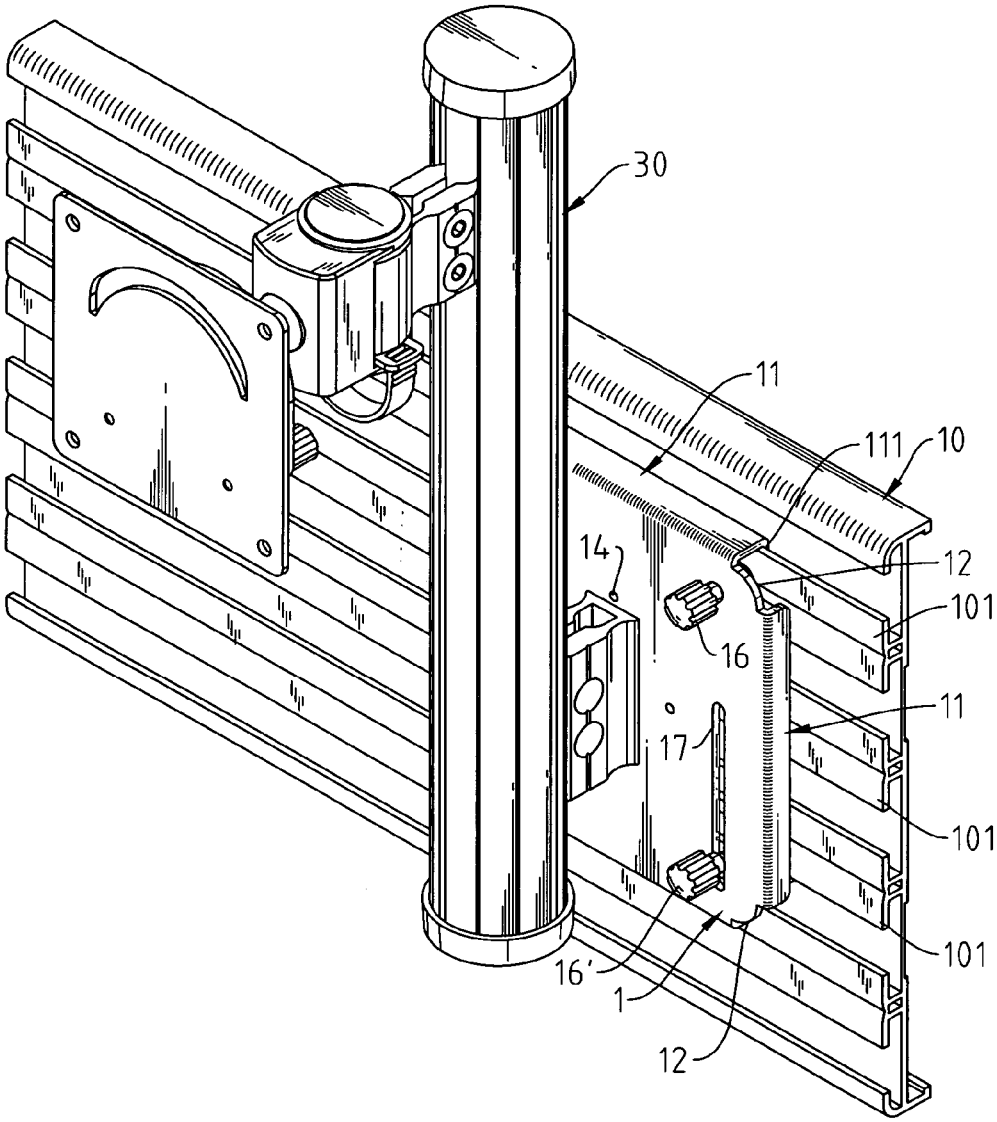
FIG. 5 is an elevational view showing that the adjustable rail-hanging apparatus of the present invention is hung on the aluminum extrusion hanging board.
Figure 6:
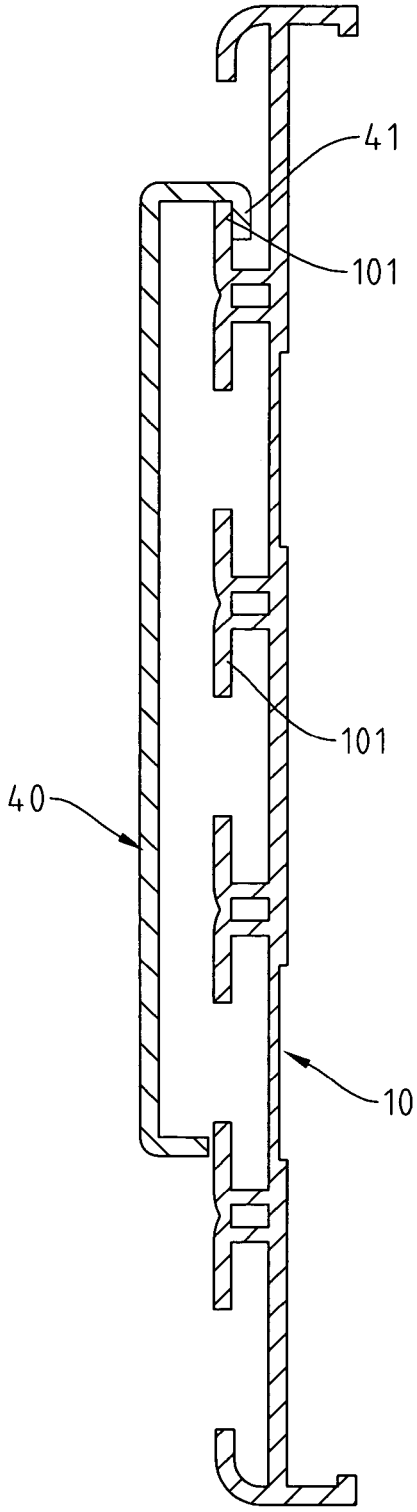
Fig. 6 Prior Art
FIG. 6 is a schematic cross-section view showing the conventional adjustable rail-hanging apparatus.

In order to clarify the performing method and the preferred embodiment of the present invention more explicitly, please further refer to FIG. 4 and FIG. 5, wherein when the locking devices 16' are released from the main body 1, the limit device 2 can shift up and down along the guiding grooves 17 to form the movable limit device 2 that cooperates with the hooking part 111 formed on the upper end of the main body 1 for adjusting distance and adapting to the aluminum extrusion hanging board 10 having rails 101 with various gauges.

Furthermore, the main body 1 can be locked securely to the aluminum extrusion hanging board 10 by use of the above-mentioned locking devices 16 such that the main body 1 is not easy to slide on both sides and the stability thereof is therefore enhanced. Besides, the locking devices 16' can hold the aluminum extrusion hanging board 10 to allow the main body 1 to be disposed more flatly on the aluminum extrusion hanging board 10 except for cooperation with the limit device 2 to adjust the holding distance of the rails 101. The hooking notches 23 of the limit device 2 further prevent the main body 1 from being hit down after collision.

FIG. 5 shows another preferred embodiment of the present invention, wherein the main body 1 is mounted on the aluminum extrusion hanging board 10, and several fitting holes 13, 14 with different-sized diameters are formed on the center of the main body 1 (the fitting holes 13 are not shown in FIG. 5) to couple with various hanging bases 20 for connecting to a bracing frame 30, thereby meeting the need to hang various articles.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

What the invention claimed is:

1. An adjustable rail-hanging apparatus comprising:

a main body and a limit device, wherein said main body comprises vertically bended lateral sides located on each four sides of said main body to form stoppers having a gap between every two adjacent stoppers, fitting holes with different-sized diameters being formed on the center of said main body, first screw holes to be inserted respectively by first locking devices being formed respectively on both sides of the upper end of said main body, wherein said first locking devices extending through the first screw holes and guiding grooves having slot being oppositely formed on both sides of said main body respectively for movably holding said limit device; and said limit device having shaft surface comprises second screw holes formed on both sides of said shaft surface, second locking devices extend through said second screw holes, each of two opposing ends of said shaft surface of said limit device being bent to form a holding part, said holding part comprising a hooking notch being formed on each of the two opposing ends of the holding part for holding a rail of an aluminum extrusion hanging board, wherein said limit device is provided with movable connection by disposing said second locking devices in said guiding grooves and through said second screw holes and securely engaging said limit device with the backside of said main body.

2. The adjustable rail-hanging apparatus of claim 1, wherein said main body is rectangular in shape.

3. The adjustable rail-hanging apparatus of claim 1, wherein said guiding grooves extend equally from the lower end of said main body to the intermediate portion of said main body.

* * * * *